US008257093B2

(12) United States Patent
Sakai et al.

(10) Patent No.: US 8,257,093 B2
(45) Date of Patent: Sep. 4, 2012

(54) ELECTRONIC APPARATUS

(75) Inventors: Masanori Sakai, Yokohama (JP); Taro Fuchigami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/019,647

(22) Filed: Feb. 2, 2011

(65) Prior Publication Data

US 2011/0189865 A1 Aug. 4, 2011

(30) Foreign Application Priority Data

Feb. 4, 2010 (JP) ..... 2010-023477

(51) Int. Cl.
*H01R 12/00* (2006.01)

(52) U.S. Cl. ..... 439/55

(58) Field of Classification Search ..... 439/55, 439/76.1, 76.2, 949, 65
See application file for complete search history.

(56) References Cited

U.S. PATENT DOCUMENTS

| | | | | |
|---|---|---|---|---|
| 7,074,053 | B2 * | 7/2006 | Kawakita et al. | 439/76.1 |
| 7,408,765 | B2 * | 8/2008 | Kanou | 361/622 |
| 7,514,629 | B2 * | 4/2009 | Sasaki et al. | 174/50 |
| 7,857,637 | B2 * | 12/2010 | Kasai | 439/76.2 |
| 7,950,931 | B2 * | 5/2011 | Nakanishi et al. | 439/76.2 |
| 2011/0256742 | A1 * | 10/2011 | Panella et al. | 439/65 |

FOREIGN PATENT DOCUMENTS

JP 2007-116736 A 5/2007

* cited by examiner

*Primary Examiner* — Jean F Duverne
(74) *Attorney, Agent, or Firm* — Canon USA Inc. IP Division

(57) ABSTRACT

Connector jacks are surface-mounted on one surface of a substrate. A reinforcing member reinforces the connector jacks. On the reinforcing member, a first reinforcing part, which is in contact with the back of the surface of the substrate on which the connector jack is mounted, and second reinforcing parts, which elastically urge the top surface of the connector jacks, are formed.

10 Claims, 9 Drawing Sheets

ELECTRONIC APPARATUS

BACKGROUND OF THE INVENTION

1. Field of the Invention

The present invention relates to an electronic apparatus and more particularly an electronic apparatus including a structure for reinforcing a connector jack surface-mounted on a substrate.

2. Description of the Related Art

Conventionally, as a method of installing a connector jack on a substrate, various methods are used such methods of soldering a connector jack on a substrate, inserting a part of a connector jack into a through hole on a substrate to solder it, and screwing a connector jack on a substrate.

As an imaging apparatus discussed in Japanese Patent Application Laid-Open No. 2007-116736, when a small connector jack is mounted on a substrate, for space saving, a method of soldering a connector jack on the surface of a substrate or a method of inserting a connector jack into a through hole on a substrate to solder it, is adopted.

However, in the method of soldering a connector jack on the surface of a substrate, strength against an external force applied to the connector jack depends on the pattern strength of the substrate. Thus, there is a problem that the connector jack is easily removed from the substrate due to a twist of a cable.

On the other hand, in the method of inserting a part of the connector jack into the through hole on the substrate to solder it, since the solder flowing into the through hole serves as reinforcement, strength is larger than that in the method of soldering the connector jack on the surface. However, the strength of solder is not so large that, when large external force is added to the connector jack, the connector jack may be removed from the substrate.

SUMMARY OF THE INVENTION

According to an aspect of the present invention, an electronic apparatus includes a substrate, a connector jack which is surface-mounted on one surface of the substrate, and a reinforcing member for the connector jack, wherein on the reinforcing member, a first reinforcing part, which is in contact with the back of the one surface of the substrate on which the connector jack is mounted, and a second reinforcing part, which elastically urges a top surface on the connector jack, are formed.

According to the present invention, an electronic apparatus can be provided in which a connector jack mounted on a substrate can be reinforced against a twist of a cable.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
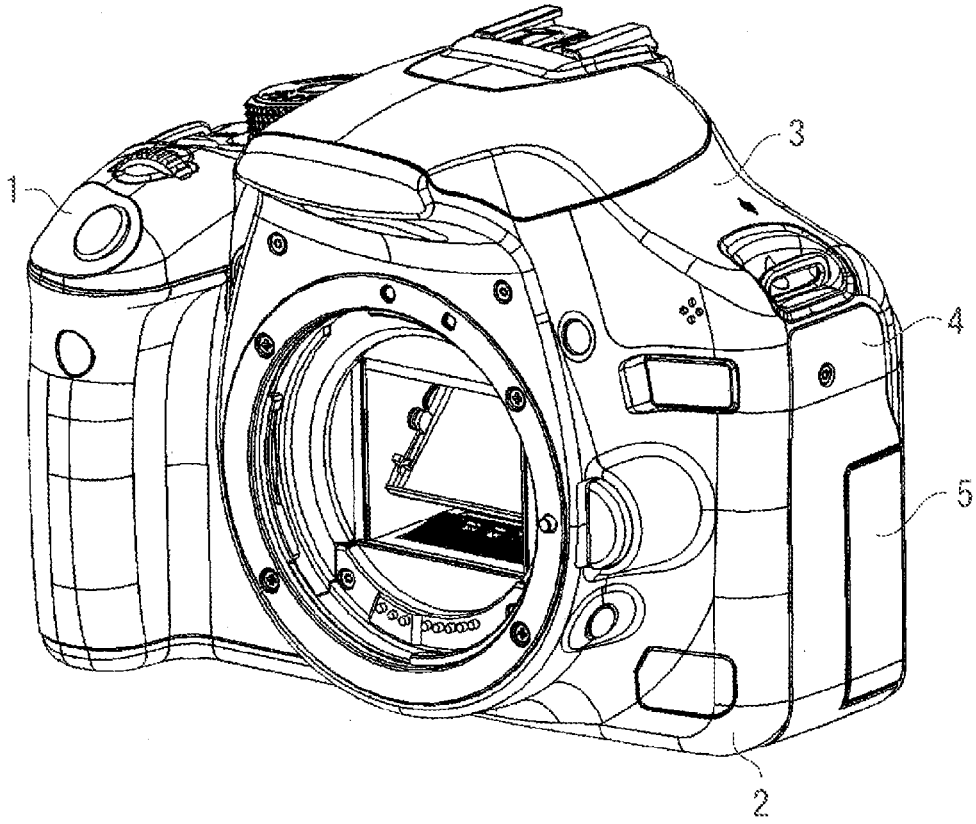
FIG. 1 illustrates a perspective view when viewed from the front of a camera according to an exemplary embodiment of the present invention.
Figure 2:
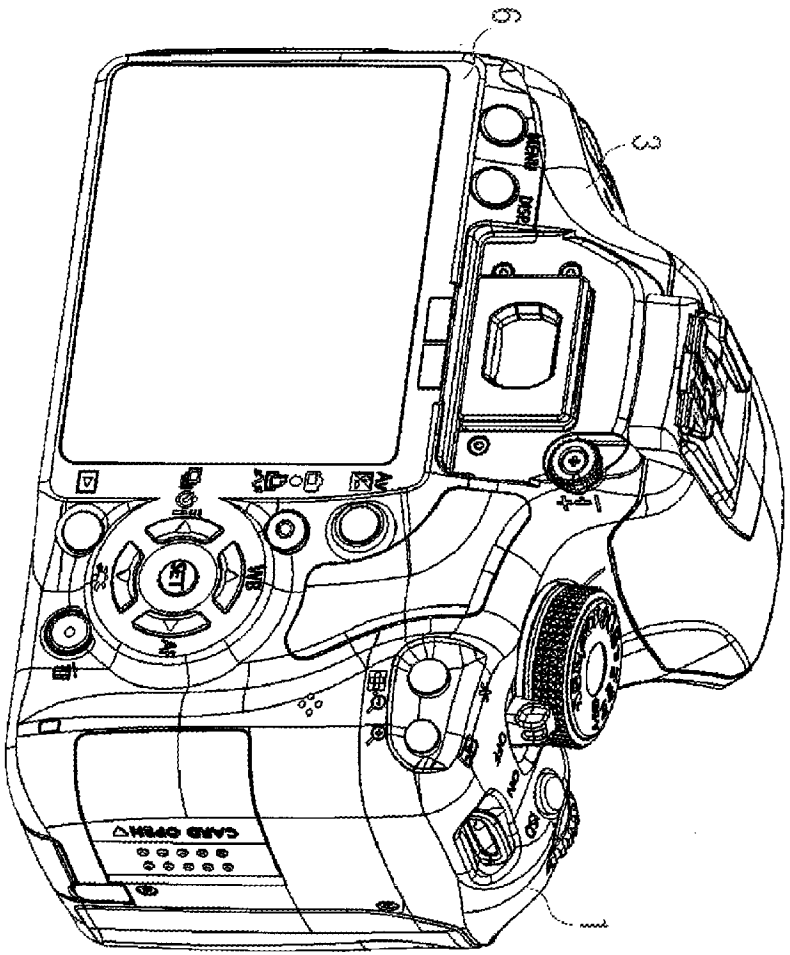
FIG. 2 illustrates a perspective view when viewed from the back of the camera according to an exemplary embodiment of the present invention.

FIG. 1 illustrates a perspective view when viewed from the front of a camera according to an exemplary embodiment of the present invention. FIG. 2 illustrates a perspective view when viewed from the back of the camera according to an exemplary embodiment of the present invention. The exterior of a camera 1, which is an electronic apparatus, includes a front cover 2, a top cover 3, a side cover 4, a terminal cover 5, and a rear cover 6.

Figure 3:
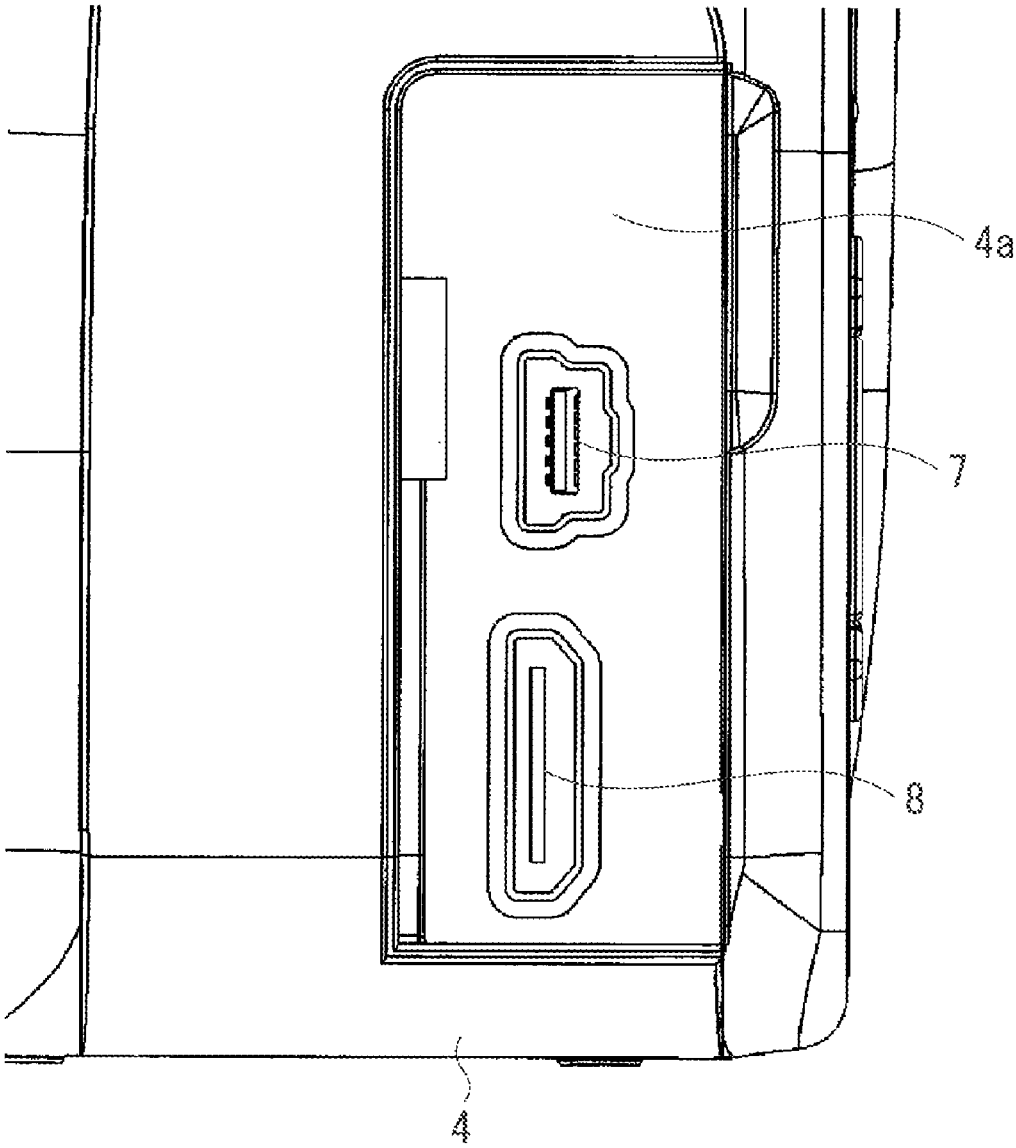
FIG. 3 illustrates a side elevation view of the camera according to an exemplary embodiment of the present invention.

FIG. 3 is a side elevation view illustrating the camera 1 with the terminal cover 5 opened. The terminal cover 5 is formed out of a material having elasticity such as a rubber or an elastomer. When the terminal cover 5 is opened, the state illustrated in FIG. 3 can be obtained. Further, for the viewability of drawings, in FIG. 3, the terminal cover 5 is omitted to be drawn.

In the portion covered with the terminal cover 5 on the side cover 4, a terminal arrangement portion 4*a* is formed. In the terminal arrangement portion 4*a*, one or a plurality of connector jacks, in this example, a Universal Serial Bus (USB) jack 7 and a High-Definition Multimedia Interface (HDMI) jack 8 are disposed thereon. Into the USB jack 7, a USB cable is inserted to be used for communication with a personal computer or other apparatuses having a USB terminal.

Further, into the HDMI jack 8, an HDMI cable is inserted to connect the camera to a digital television or other apparatuses having an HDMI terminal. Thus, a video/voice signals can be transmitted to the digital television.

Figure 4:
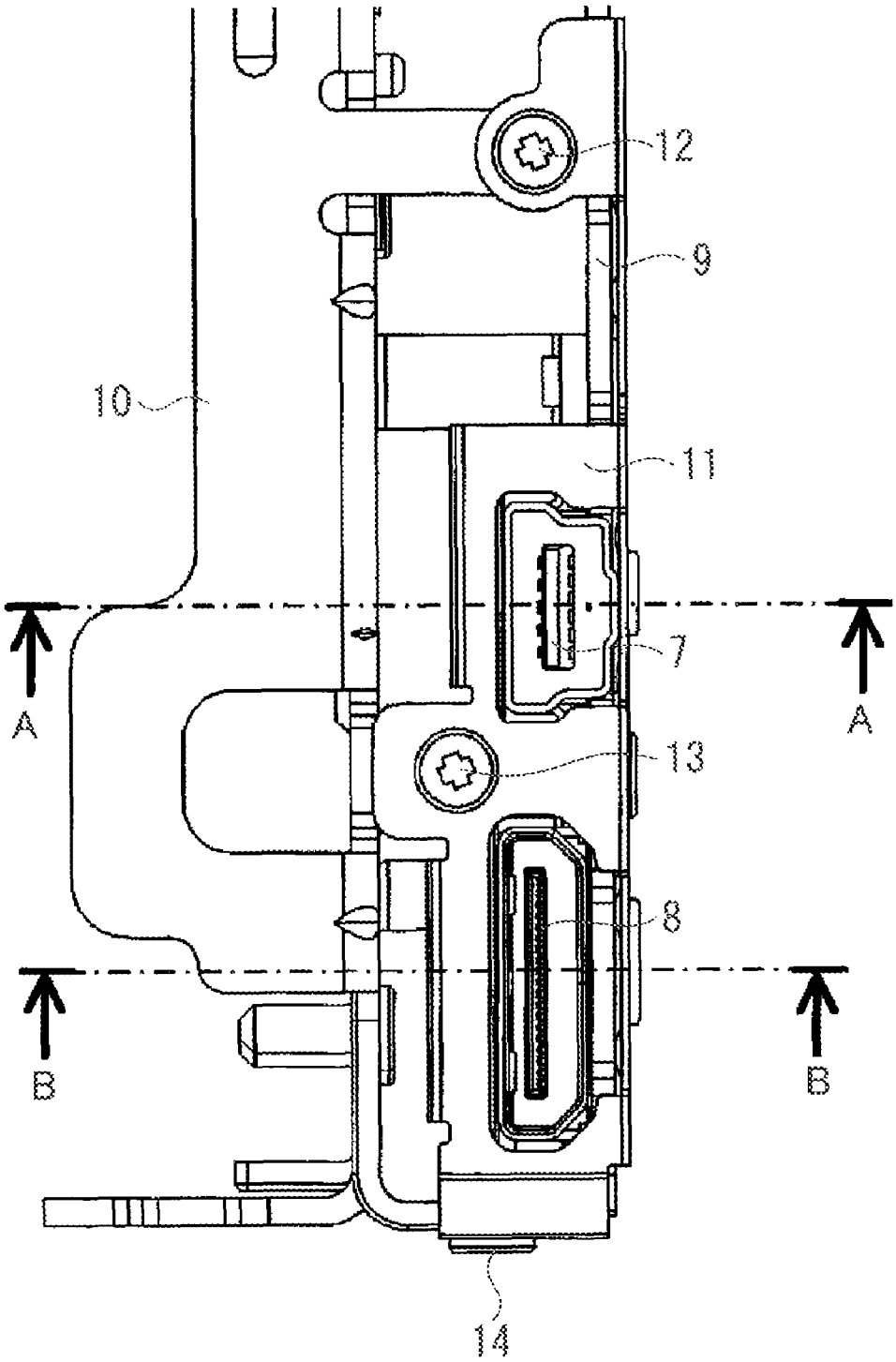
FIG. 4 is a side elevation view illustrating an internal structure of the camera according to an exemplary embodiment of the present invention.
Figure 5:
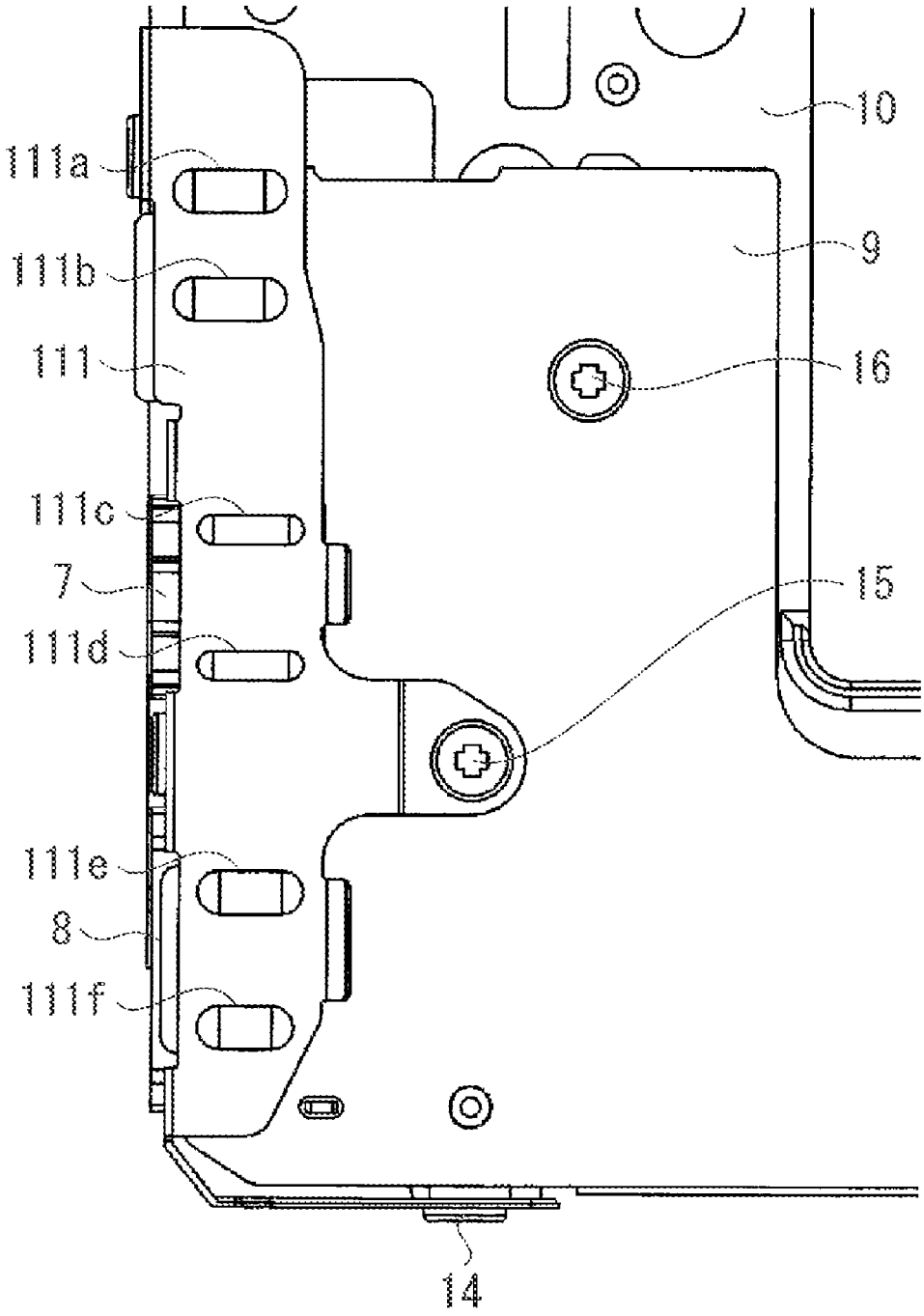
FIG. 5 is a rear elevation view illustrating the internal structure of the camera according to an exemplary embodiment of the present invention.
Figure 6:
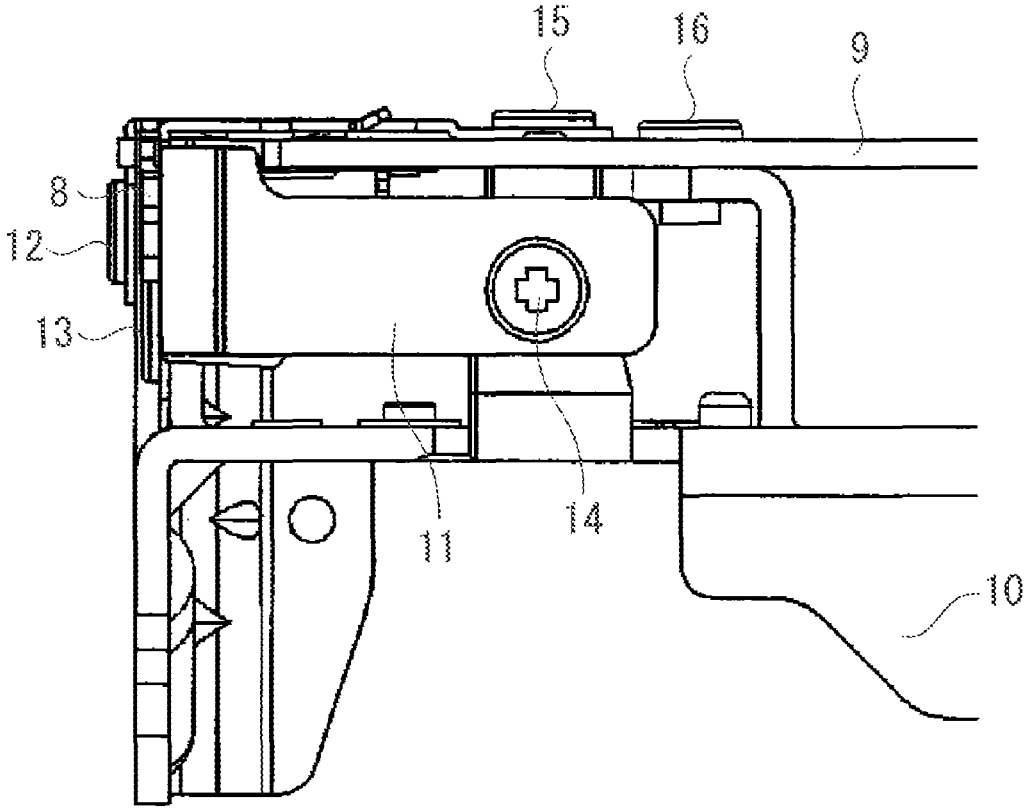
FIG. 6 is a bottom plan view illustrating the internal structure of a camera according to an exemplary embodiment of the present invention.

Next, referring to FIGS. 4 to 6, the internal structure of the camera 1 will be described. FIGS. 4 to 6 illustrate the state in which the front cover 2, the top cover 3, the side cover 4, the terminal cover 5, and the rear cover 6 are removed from the camera 1. FIG. 4 is a side elevation view illustrating the internal structure of the camera 1. FIG. 4 is viewed from the similar direction to FIG. 3. FIG. 5 is a rear elevation view illustrating the internal structure of the camera 1. Only the left side portion when viewed from the back of the camera 1 is illustrated. FIG. 6 is a bottom plan view illustrating the internal structure of the camera 1, when FIG. 5 is viewed from the bottom side.

In these FIGS. 4 to 6, on a substrate 9, patterns for forming a circuit to execute various types of control of the camera 1 are formed and various electric elements are mounted. On the substrate 9, the USB jack 7 and the HDMI jack 8 are surface-mounted on the back side of a space in FIG. 5 (particularly, referring to FIG. 7, it is mounted on a mounting surface 9*a* on the substrate 9).

A chassis 10 is a framework of the camera 1. The chassis 10 is made of metal. The chassis 10 is electrically connected to the ground of a battery (not illustrated). A reinforcing member 11 is a member used to reinforce the USB jack 7, the HDMI jack 8, and the substrate 9.

The reinforcing member 11 is fastened on the chassis 10 with screws 12 and 13 from the side, and a screw 14 from the bottom. Further, the reinforcing member 11 and the substrate 9 are fastened on the chassis 10 with a screw 15 from the back. Furthermore, the substrate 9 is fastened on the chassis 10 with a screw 16. Thus, the reinforcing member 11 has conductivity and is fastened on the chassis 10 connected to the ground of the battery with screws. Accordingly, the reinforcing member 11 also has a structure connected to the ground of the battery.

Still furthermore, on the reinforcing member 11, a substrate reinforcing part 111, which is a first reinforcing part, is formed. Bead parts 111*a* to 111*f* on the substrate reinforcing part 111 are integrally formed so as to contact the substrate 9 (back of mounting surface 9*a* on substrate 9). In a case in which the USB jack 7 and the HDMI jack 8 are inserted into a cable, even when a twist occurs, deformation of the substrate 9 can reduced. Thus, pattern break and removal of solder of a signal line to the USB jack 7 and the HDMI jack, which may occur due to significant warpage of the substrate 9, can be prevented.

In the present exemplary embodiment, the bead parts 111*a* to 111*f* are formed for the purpose of reinforcement when a twist occurs on the substrate 9 and reinforcement of the reinforcing member 11 itself. However, in order to achieve the similar purpose, other measures can also be used.

Figure 7:
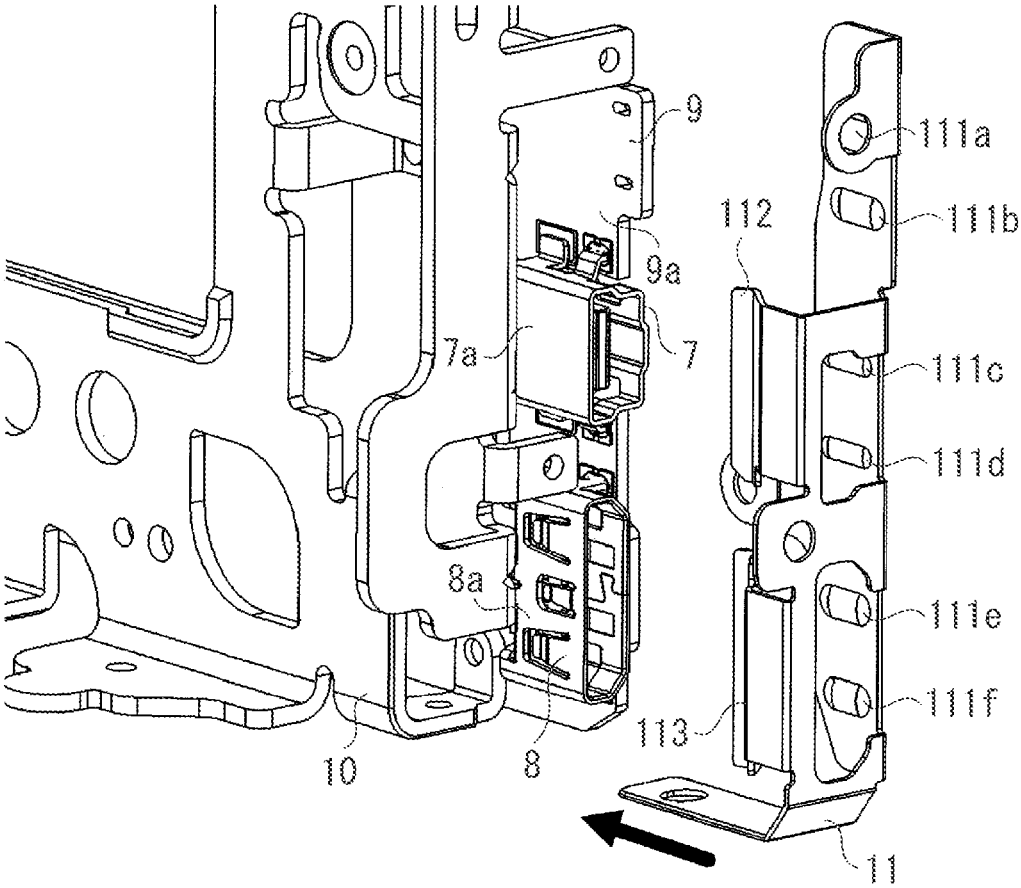
FIG. 7 is an exploded perspective view illustrating a structure of a reinforcing member.
Figure 8A:
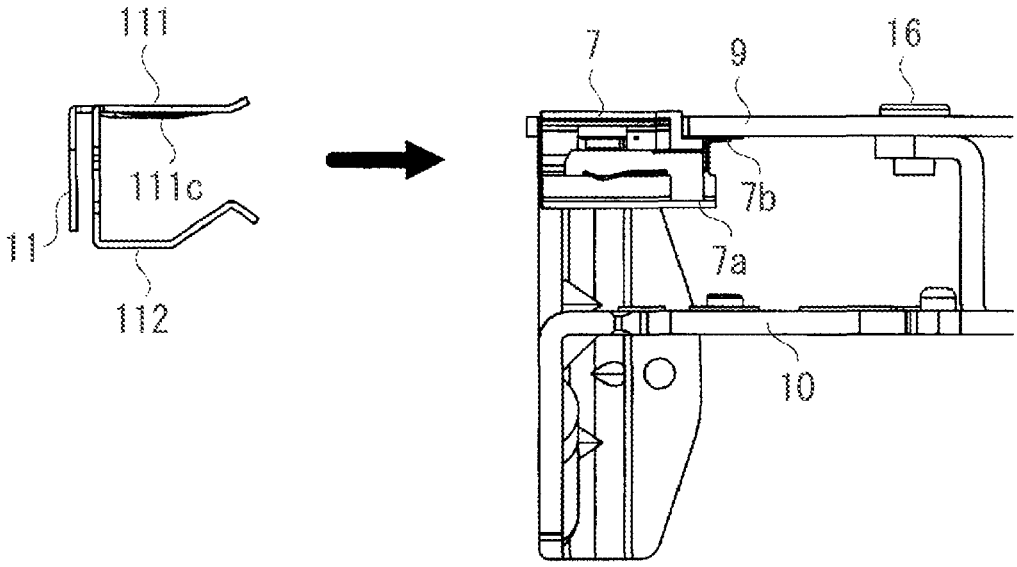
FIGS. 8A and 8B are cross sectional views illustrating the structure of a reinforcing member in an exploded state.
Figure 8B:
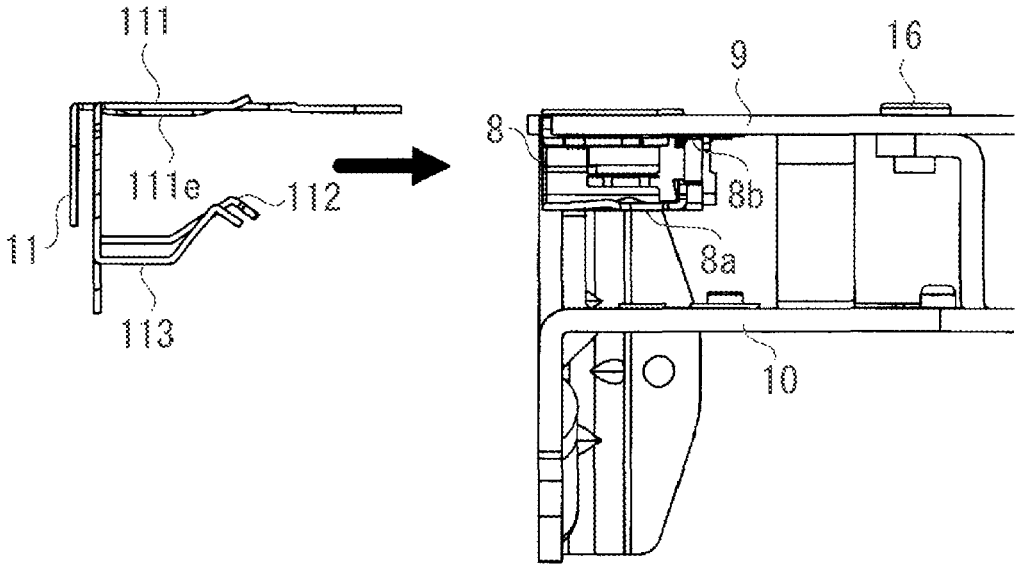
Figure 9A:
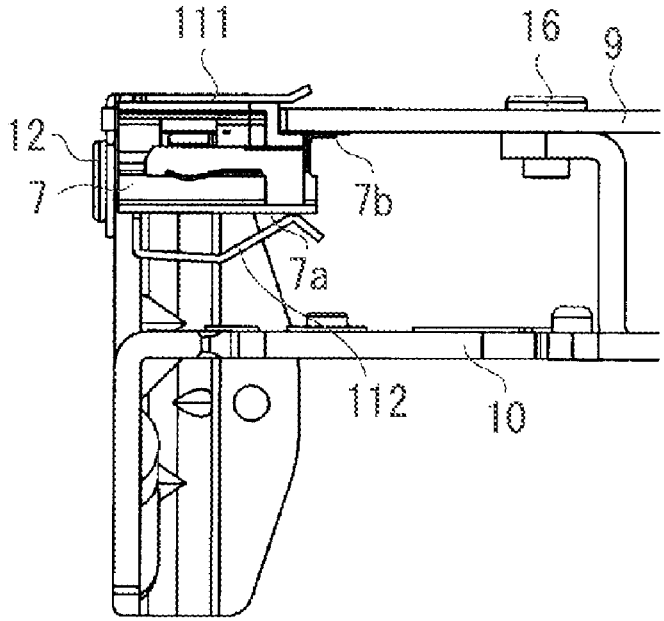
FIGS. 9A and 9B are cross sectional views illustrating the structure of a reinforcing member in a completely mounted state.
Figure 9B:
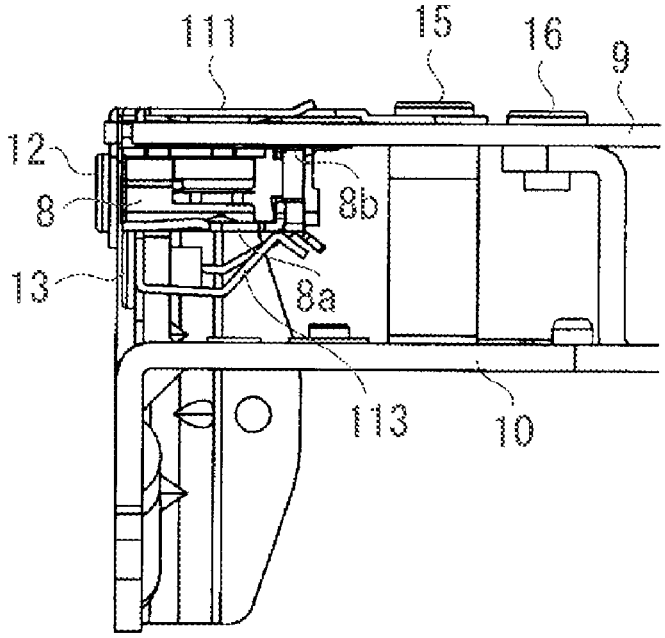

Next, the structure of the reinforcing member 11 will be described referring to FIGS. 7 and 8. FIG. 7 is an exploded perspective view illustrating the state before the reinforcing member 11 is attached. FIG. 7 is viewed from the similar direction to FIG. 1. FIGS. 8A and 8B are cross sectional views illustrating the state before the reinforcing member 11 is attached. FIGS. 8A and 8B illustrate cross sectional views taken along line A-A and taken along line B-B of FIG. 4, respectively. FIGS. 9A and 9B are cross sectional views illustrating the state after the reinforcing member 11 is completely attached. Similar to FIGS. 8A and 8B, FIGS. 9A and 9B illustrate cross sectional views taken along line A-A and taken along line B-B of FIG. 4, respectively.

The reinforcing member 11 is attached in a direction of the arrow in FIGS. 7 and 8. On the reinforcing member 11, a USB reinforcing part 112 and an HDMI reinforcing part 113, which are second reinforcing parts, are formed. The USB reinforcing part 112 and the HDMI reinforcing part 113 elastically urge top surfaces 7*a* and 8*a* on the USB jack 7 and the HDMI jack 8, respectively. FIGS. 9A and 9B illustrate the state in which the USB reinforcing part 112 and the HDMI reinforcing part 113 are elastically deformed to hold the USB jack 7 and the HDMI jack 8.

When a cable is inserted into the USB jack 7 and the HDMI jack 8, and a twist occurs, the fulcrum of the twist is present in the vicinity of a cable insertion port. Further, the point of action of the twist is solder portions 7*b* and 8*b* where each signal line of the USB jack 7 and the HDMI jack 8 is soldered on the substrate 9. Thus, in order to perform more effective reinforcement, each of the USB reinforcing part 112 and the HDMI reinforcing part 113 is formed so as to hold the vicinity of the solder portions 7*b* and 8*b* among regions of the top surfaces 7*a* and 8*a* on the USB jack 7 and the HDMI jack 8.

On the other hand, in an electronic apparatus having a high-speed communication terminal such as a USB and an HDMI, radiation noise suppression performance may be concerned. In the present exemplary embodiment, since the USB jack 7 and the HDMI jack 8 are connected to the ground of the battery via the USB reinforcing part 112 and the HDMI reinforcing part 113, the radiation noise suppression performance can be improved.

A preferred exemplary embodiment of the present invention has been described above. However, the present invention is not limited to these exemplary embodiments. Various modifications and changes may be made within the scope of the subject matter of the invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-023477 filed Feb. 4, 2010, which is hereby incorporated by reference herein in its entirety.

What is claimed is:

1. An electronic apparatus comprising:

a substrate;

a connector jack which is mounted on one surface of the substrate; and a reinforcing member for the connector jack and the substrate, wherein the reinforcing member has a first reinforcing part and a second reinforcement part, wherein the first reinforcing part is in contact with the back of the one surface of the substrate on which the connector jack is mounted, and wherein the second reinforcing part elastically urges a top surface on the connector jack.

2. The electronic apparatus according to claim 1, wherein the second reinforcing part holds the vicinity of a solder portion at which a signal line for the connector jack is soldered on the substrate within a region of the top surface of the connector jack.

3. The electronic apparatus according to claim 1, wherein the reinforcing member has conductivity and is connected to the ground.

4. The electronic apparatus according to claim 3, further comprising a chassis having conductivity and connected to the ground, wherein the reinforcing member is electrically connected with the chassis.

5. The electronic apparatus according to claim 1, wherein a plurality of bead parts are formed on the first reinforcing part, and wherein the plurality of bead parts are in contact with the back of the one surface of the substrate.

6. An electronic apparatus comprising:

a substrate;

a first connector jack which is mounted on one surface of the substrate;

a second connector jack which is mounted on one surface of the substrate; and a reinforcing member for the first connector jack, the second connector jack and the substrate, wherein the reinforcing member has a first reinforcing part, a second reinforcing part and a third reinforcing part, wherein the first reinforcing part is in contact with the back of the one surface of the substrate on which the first and second connector jacks are mounted, wherein the second reinforcing part elastically urges a top surface on the first connector jack, and the third reinforcing part elastically urges a top surface on the second connector jack respectively.

7. The electronic apparatus according to claim 6, wherein the second reinforcing part holds the vicinity of a solder portion at which a signal line for the first connector jack is soldered on the substrate within a region of the top surface of the first connector jack, wherein the third reinforcing part holds the vicinity of a solder portion at which a signal line for the second connector jack is soldered on the substrate within a region of the top surface of the second connector jack.

8. The electronic apparatus according to claim 6, wherein the reinforcing member has conductivity and is connected to the ground.

9. The electronic apparatus according to claim 8, further comprising a chassis having conductivity and connected to the ground, wherein the reinforcing member is electrically connected with the chassis.

10. The electronic apparatus according to claim 6, wherein a plurality of bead parts are formed on the first reinforcing part, and wherein the plurality of bead parts are in contact with the back of the one surface of the substrate.

* * * * *